US006412919B1

(12) United States Patent
Ghozeil et al.

(10) Patent No.: US 6,412,919 B1
(45) Date of Patent: Jul. 2, 2002

(54) TRANSISTOR DROP EJECTORS IN INK-JET PRINT HEADS

(75) Inventors: Adam L. Ghozeil; Michael J. Barbour, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/655,219

(22) Filed: Sep. 5, 2000

(51) Int. Cl.[7] ..... B41J 2/05
(52) U.S. Cl. ..... 347/57; 347/59
(58) Field of Search ..... 347/50, 57–59; 438/179, 182, 931; 219/216

(56) References Cited

U.S. PATENT DOCUMENTS

| | | | | |
|---|---|---|---|---|
| 4,719,477 A | | 1/1988 | Hess | 347/59 |
| 4,897,710 A | | 1/1990 | Suzuki | 257/77 |
| 5,122,812 A | * | 6/1992 | Hess et al. | 347/59 |
| 5,609,910 A | | 3/1997 | Hackleman | 427/102 |
| 5,885,860 A | * | 3/1999 | Weitzel et al. | 438/179 |

OTHER PUBLICATIONS

High Temperature and Radiation–reisstant Semiconductor Devices for the Next Stage; Jan. 1998; Japan Atomic Energy Research Institute (Persistent Quest).

Neudeck, P.; Recent Progress in Silicon Carbide Semiconductor Electronics Technology; NASA Lewis Research Center; Oct. 1995.

Lam et al; Recent Progress of Submicron CMOS Using 6H–SiC for Smart Power Applications; IEEE Transactions on Electron Devices, vol. 46, No. 3, Mar. 1999.

Vathulya et al; A Novel 6H–SiC Power DMOSFET with Implanted P–Well Spacer; IEEE Electron Device Letters, vol. 20, No. 7, 1999.

Schomer et al; Detailed Investigation of N–Channel Enhancement 6H–Sic MOSFETs; IEEE Transactions on Electron Devices, vol. 46, No. 3, Mar. 1999.

* cited by examiner

*Primary Examiner*—John Barlow
*Assistant Examiner*—Juanita Stephens

(57) ABSTRACT

The functions of an ink-jet print head drive transistor and ink-ejecting heat transducer (resistor) are combined into a single component, a high-temperature transistor. The transistor is turned on when an ink drop is required, and the resultant heat generated by the transistor is used for creating the vapor bubble for ejecting the ink drop. The drop-ejector transistor is a silicon carbide transistor.

20 Claims, 3 Drawing Sheets

TRANSISTOR DROP EJECTORS IN INK-JET PRINT HEADS

TECHNICAL FIELD

This invention relates to the construction of ink drop ejector components of print heads used in ink-jet printing.

BACKGROUND AND SUMMARY OF THE INVENTION

An ink-jet printer typically includes one or more cartridges that contain ink. In some designs, the cartridge has discrete reservoirs of more than one color of ink. Each reservoir is connected via a conduit to a print head that is mounted to the body of the cartridge.

The print head is controlled for ejecting minute drops of ink from the print head to a printing medium, such as paper, that is advanced through the printer. The ejection of the drops is controlled so that the drops form recognizable images on the paper.

The ink drops are expelled through orifices that are formed in an orifice plate that covers most of the print head. The orifice plate is typically bonded atop an ink barrier layer of the print head. That barrier layer is shaped to define ink chambers. Each chamber is aligned with, and continuous with, an orifice through which the ink drops are expelled.

The ink drops are expelled from an ink chamber by a heat transducer, which in the past comprised a thin-film resistor. The resistor is carried on an insulated substrate, such as a conventional silicon die upon which has been grown an insulation layer, such as silicon dioxide. The resistor is covered with suitable passivation and cavitation-protection layers, as is known in the art and described, for example, in U.S. Pat. No. 4,719,477, hereby incorporated by reference.

The resistor is selectively driven (heated) with pulses of electrical current. The heat from the resistor is sufficient to form a vapor bubble in an ink chamber, the rapid expansion of which propels a drop through the associated orifice. The chamber is refilled after each drop ejection with ink that flows into the chamber through a channel that connects with the conduit of reservoir ink. The components of the print head, such as the heat transducer, for ejecting drops of ink are oftentimes referred to as drop ejectors. The action of ejecting a drop of ink is sometimes referred to as "firing" the drop ejector.

Early print head designs included a dedicated conductive trace that was interconnected between each resistor and a flexible circuit carried on the body of the cartridge. The flexible circuit mates with a circuit in the carriage that holds the cartridge. Control signals are provided from the printer controller, via the mated circuits, to the individual traces for heating the associated resistors as needed for firing drops.

Print heads having higher resolutions and smaller resistors were introduced as the development of print cartridges continued. While adding more resistors increased the number of ink drops that could be expelled from a print head, it also raised problems with the manufacture of such print heads. In particular, it became impractical and expensive to directly connect individual resistors with dedicated conductive paths to the circuit carried on the cartridge.

To resolve this problem, later versions of print heads were developed with control circuitry (data shifters, buffers, address generators, etc.) placed on the print head substrate with the resistors, instead of in the printer controller firmware. This approach greatly increased the number of resistors that could be addressed (fired) while minimizing the number of interconnections required. U.S. Pat. No. 5,122,812 to Hess, hereby incorporated by reference, describes such a print head having drive circuit components integrated with the resistors on the same substrate. A transistor component of the drive circuit is switched to direct the current pulses through the resistor.

Each drive transistor of conventional print heads is designed so that its resistance (when it is switched on) is low with respect to the firing resistor in order to minimize the power that is used by the transistor and thus made unavailable to the resistor. The transistor area, therefore, is relatively large to ensure this low-resistance requirement is met.

The present invention essentially combines the function of the drive transistor and firing resistor into a single component. In particular, a high-temperature transistor is used as the drop ejector in the print head. The transistor is turned on when an ink drop is required, and the resultant heat generated by the transistor is used for creating the vapor bubble heretofore created by a separate resistor component.

Since, in accordance with the present invention, it is desirable to heat the transistor, the transistor can be made very small to increase its resistance (heat) for a given current and enabling the spacing between transistors (packing density) to be minimized so that high-resolution printing is possible.

In one approach to the present invention, each of the numerous drop ejectors is a silicon carbide transistor. Each transistor is fabricated on a thermally insulating print head substrate or base. Each ink chamber formed in the barrier layer of the print head is located adjacent to one of the transistors so that the heat generated by a transistor in its "on" state is immediately transferred to the ink in the chamber to generated the vapor bubble that ejects the ink drop.

It will be appreciated that the foregoing use of a transistor as an ink drop ejector (as well as drive control element) greatly simplifies the print head design.

In one preferred embodiment, the components of the print head—including a source, gate, and drain, as well as discrete conductive layers to which the source, gate, and drain are connected for directing power and control signals to the transistor—are covered with layers to protect the transistor for corrosion and cavitation damage.

In another embodiment, the transistor is arranged in what might be considered an inverted orientation so that the ink chamber overlies the silicon carbide substrate of the transistor on a "passive" surface of that substrate that is opposite the surface that carries the primary transistor components (gate, etc). As a result, the silicon carbide substrate of the transistor also serves the purpose of the protective layers so that ink does not reach the transistor components and the deleterious effects of cavitation are avoided.

In yet another embodiment, the silicon carbide transistor substrate is mounted to a print head base that was previously attached to the cartridge. The transistor is thereafter fabricated (patterned, etched, etc.) directly on the attached transistor substrate, thereby avoiding the expense and extra steps involved in separately fabricating the transistors on a print head base (such as a silicon wafer), cutting the wafer into dies and separately attaching each die to a cartridge.

In yet another embodiment, the drop ejector is formed as a resistive diode junction in a silicon carbide substrate. Connections to such drop ejectors are minimized with a row/column multiplexing technique for selectively heating the individual diodes.

Apparatus and methods for carrying out the invention are described in detail. Other advantages and features of the present invention will become clear upon review of the following portions of this specification and the drawings.

DETAILED DESCRIPTION OF PREFERRED EMBODIMENTS

Figure 1:
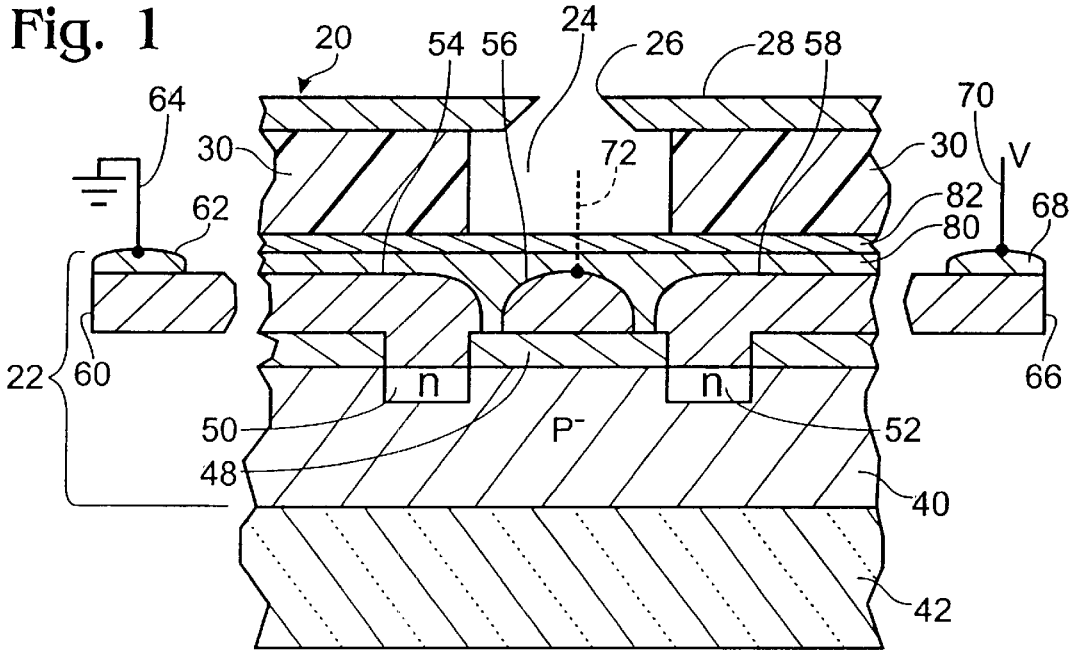
FIG. 1 is a cross-sectional view of one embodiment of a transistor-type drop ejector that is incorporated into a print head of an ink-jet printer.

The diagram of FIG. 1 shows a complete transistor-type drop ejector 20 formed in accordance with the present invention. The drop ejector 20 is incorporated in the print head of an otherwise conventional ink-jet print cartridge and primarily features a high-temperature transistor 22 that is located adjacent to an ink chamber 24. The illustrated transistor 22 and associated ink chamber 24 represent one of a set of many that are built into the print head.

Ink is supplied to the chamber 24 by conventional mechanisms, such as a conduit (not shown) that connects with a reservoir of ink carried in the print cartridge to which the print head is attached. When an ink drop is to be ejected from the print head during a printing operation, the transistor 22 is turned "on" and the current that passes through the transistor instantaneously heats the ink in the chamber 24 to form an expanding vapor bubble. The bubble forces a drop of ink from the chamber 24, through an orifice 26. The orifice 26 is formed in an orifice plate 28 that covers most of the print head. The orifice plate 28 is typically bonded atop an ink barrier layer 30 of the print head. That layer is shaped to define the ink chambers 24 so that each chamber is aligned with, and continuous with, an orifice 26 through which the individual ink drops are expelled.

As noted, this embodiment of the invention combines the function of a drive transistor and a firing resistor into a single-component drop ejector 20 that, among other things, greatly simplifies the print head design.

Figure 2:
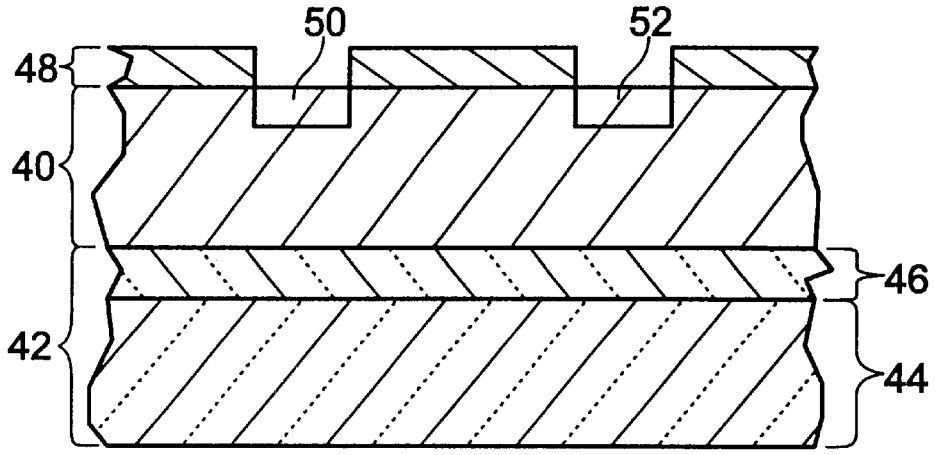
FIGS. 2 and 3 are diagrams for illustrating steps in manufacturing the drop ejector of FIG. 1.
Figure 3:
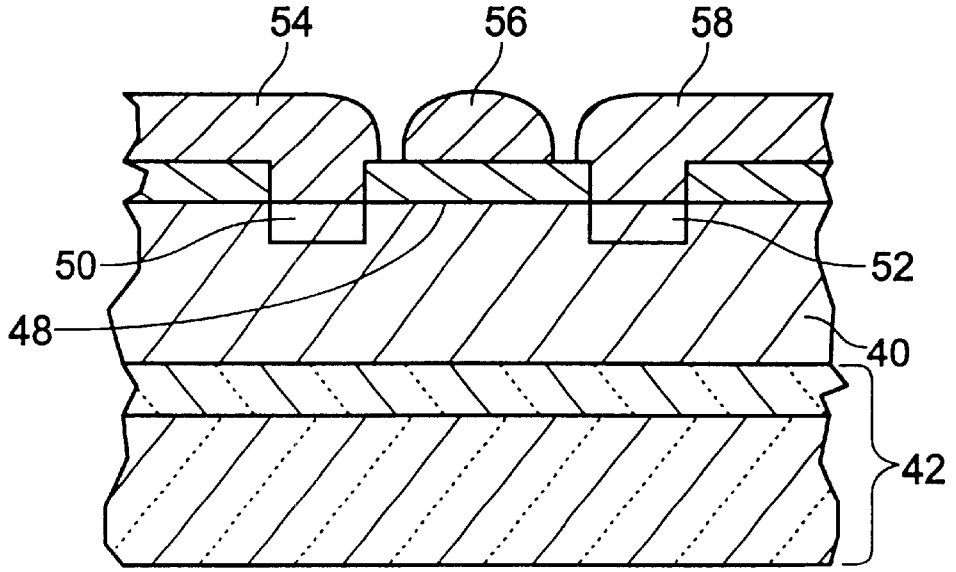

Turning now to the particulars of a preferred embodiment of the invention, and with reference to FIGS. 2 and 3 (which illustrate interim fabrication steps), a p-type monocrystalline silicon carbide (SiC) substrate layer 40 is grown on a print head base 42. The print head base 42 preferably comprises monocrystalline silicon 44 having an upper layer of thermally insulating silicon dioxide 46 formed thereon, for example, by thermal oxidation.

The silicon 44 may be about 20 mils thick, and the upper silicon dioxide layer is about 20,000 angstroms thick. Any of a variety of other print head bases may be used, such as silicon nitride.

The SiC layer 40 preferably has a thickness of about 20 mils or more and is covered with a dielectric layer 48, such as silicon dioxide. The silicon dioxide layer is patterned, developed, and etched using conventional photolithographic techniques to define the spaced-apart source 50 and drain 52 regions of the transistor.

The source region 50 and drain region 52 of the transistor are doped with nitrogen ions ($N_2^+$) using, for example, a hot ion-implantation technique at a temperature of about 800° C. In the event that an n-type silicon carbide substrate is employed, aluminum ions (Al+) may be used to produce p-type regions 50, 52.

After doping, a conductive layer is patterned and deposited on the upper or "active" surface of the transistor (FIG. 3). In particular, the conductive layer, which, when complete, comprises three portions 54, 56, 58, may be aluminum, copper or gold, or combinations of aluminum and copper. The conductive layer is applied by conventional sputtering or vapor deposition techniques.

One portion of the conductive layer, called the source conductor 54 contacts the source region 50 of the transistor substrate 40 and extends therefrom (see FIG. 1) to a location where its exposed terminus 60 is covered with an external, conductive contact layer 62 to which a lead 64 to ground is connected.

Similarly, another portion of the conductive layer, called the drain conductor 58, contacts the drain region 52 of the transistor substrate 40 and extends thereform (FIG. 1) to a location where its exposed terminus 66 is covered with a conductive contact layer 68 to which a lead 70 is provided to conduct power to the transistor.

The portion of the conductive layer serving as the gate electrode 56, applied to the oxide layer 48, is connected to a lead (shown schematically at 72 in FIG. 1) that conducts control signals from the printer controller for selectively turning on the transistor 22 for heating the ink in chamber 24 as described above.

In this embodiment, the just described transistor components on the active surface of the transistor are covered with a passivation layer 80 (FIG. 1) that preferably comprises silicon nitride. Passivation layer 80 is applied by plasma-enhanced chemical vapor deposition (PECVD). The main function of the passivation layer 80 is to protect the transistor components from any corrosive action of ink used in the cartridge. This is important because any physical damage can impair the operation of the transistor. The passivation layer 80 can have a thickness of about 5000 angstroms. Another, similarly applied protective layer of silicon carbide may be added, if needed, for further protection from corrosion damage.

The formation and collapse of the vapor bubbles in the ink chamber 24 can result in cavitation damage to the transistor 22. Thus, another protective layer in the form of a cavitation-protection layer 82 (or, simply, cavitation layer 82) is applied over the passivation layer 80 (FIG. 1). This layer 82 eliminates or minimizes mechanical damage to the transistor components and to the passivation layer. In a preferred embodiment, the cavitation layer 82 consists of tantalum, although tungsten or molybdenum may also be used. The cavitation layer 82 is preferably applied by conventional sputtering techniques, and is normally about 6000 angstroms thick.

The above-mentioned barrier layer 30 is applied to overlie the cavitation layer 82 and passivation layer 80. The barrier layer 30 is preferably made of an organic polymer plastic, such as polymethylmethacrylate, which is substantially inert to the corrosive action of ink. Exemplary plastic polymers suitable for this purpose include products sold under the names VACREL by E.I. DuPont de Nemours and Co. of Wilmington, Del. The barrier layer 80 is applied by conventional lamination techniques.

A section of the barrier layer 30 directly above each transistor 22 is removed or selectively applied in a conventional manner during the manufacturing process in order to form the ink chambers 24 mentioned above.

The orifice plate 28 is attached to the surface of the barrier layer 30 as shown in FIG. 1. The orifice plate 28 is preferably electroformed nickel and includes the orifices 26 formed therein. Each orifice is directly above and aligned with the center of the transistor 22 and centered on its associated ink chamber 24. It is noteworthy that other barrier layer and orifice plate designs are contemplated. For instance, the barrier layer and orifice plate could be a unitary polymeric member.

The transistor 22 electrically communicates with a conventional source of drain voltage, via drain conductor 58 and lead 70 as described above, which is located externally in the printer unit (not shown). The source conductor 54 provides the connection to ground. Also, as noted, the gate 56 is opened and closed via control pulses provided by the printer controller. Thus, whenever the transistor is placed in the "on" state, and power is supplied to the transistor, the resultant flow of current through the resistor will generate sufficient heat to vaporize ink in the chamber 24 to fire a drop therefrom.

It will be appreciated that by varying the time that transistor is turned on (or by controlling the power to the on-state transistor) the amount of heat generated by the transistor will vary to thus vary the volume of the ink drops ejected from the chamber. This useful variation in drop size volume is preferably carried out using the transistor gate 56, thereby eliminating the need for other such volume-control transistors on the print head.

In a preferred embodiment, the transistor fabrication just described is carried out before the print head is attached to the print cartridge. Alternatively, the silicon carbide transistor substrate may be mounted to a print head base that was previously attached to the cartridge. The transistor components are thereafter fabricated directly on the transistor substrate, thereby avoiding the expense and extra steps involved in separately fabricating the transistors on a print head base (such as a silicon wafer), cutting the wafer into dies and separately attaching each die to a cartridge. In this regard, the substrate to which the transistor is mounted need not be silicon. Any of a number of thermally insulating substrates will suffice.

Figure 4:
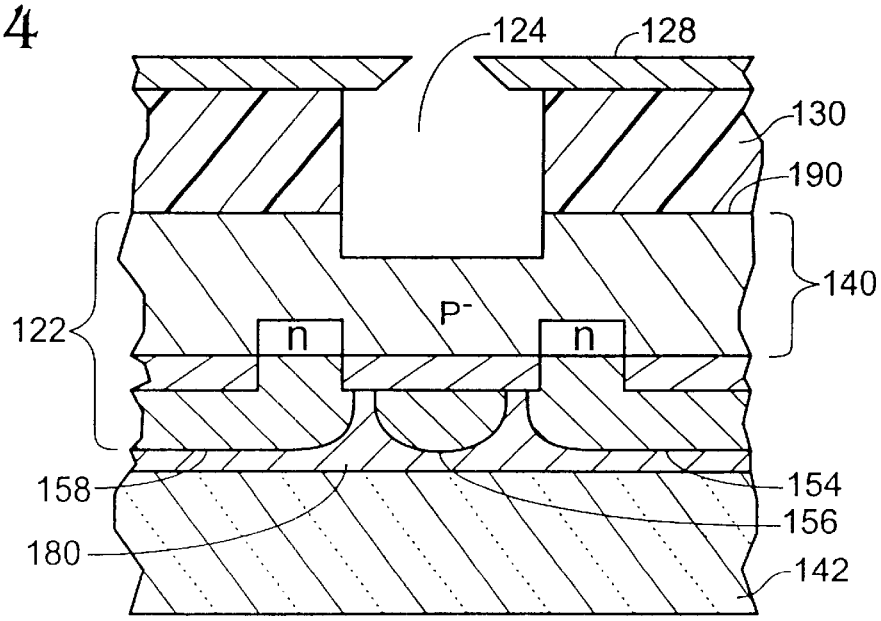
FIG. 4 is a cross-sectional view of another embodiment of a transistor-type drop ejector that is incorporated into the print head of an ink-jet printer.

The alternative embodiment depicted in FIG. 4 generally employs the silicon carbide substrate 140 of the transistor 122 as the support for the ink barrier layer 130 to thus eliminate the need for the passivation and cavitation-protection layers between the transistor and ink chamber as described above. This is accomplished, essentially, by inverting a fabricated transistor 122 so that the "passive" surface 190 of the silicon carbide transistor substrate 140 (that is, the surface opposite the active surface that carries the primary transistor components such as gate 156, source 154, and drain 158 etc) faces the ink chamber 124.

With the barrier layer 130 (and orifice plate 128) mounted to this passive surface 90, this alternative embodiment thus locates silicon carbide (the transistor substrate) between the ink chamber and the transistor components so that the corrosive and cavitation mechanisms present in the former do not damage the latter.

The embodiment depicted in FIG. 4 also shows an optional, thinned (as by etching) portion of the substrate 140 underlying the ink chamber 124. The effect of the thinning is to increase the surface area of the heated SiC substrate material that is exposed to the ink, thereby enhancing the heat transfer efficiency from the transistor to the ink in the chamber. It is also contemplated that the SiC substrate could be thick enough to define the entire chamber 124, thereby eliminating the need for a barrier layer 130.

FIG. 4 also depicts an optional covering or sealing layer 180 made of, for example, silicon nitride, that is applied to the active surface of the transistor to facilitate mounting of the transistor to a thermally insulating substrate, such as silicon dioxide 142.

Figure 5:
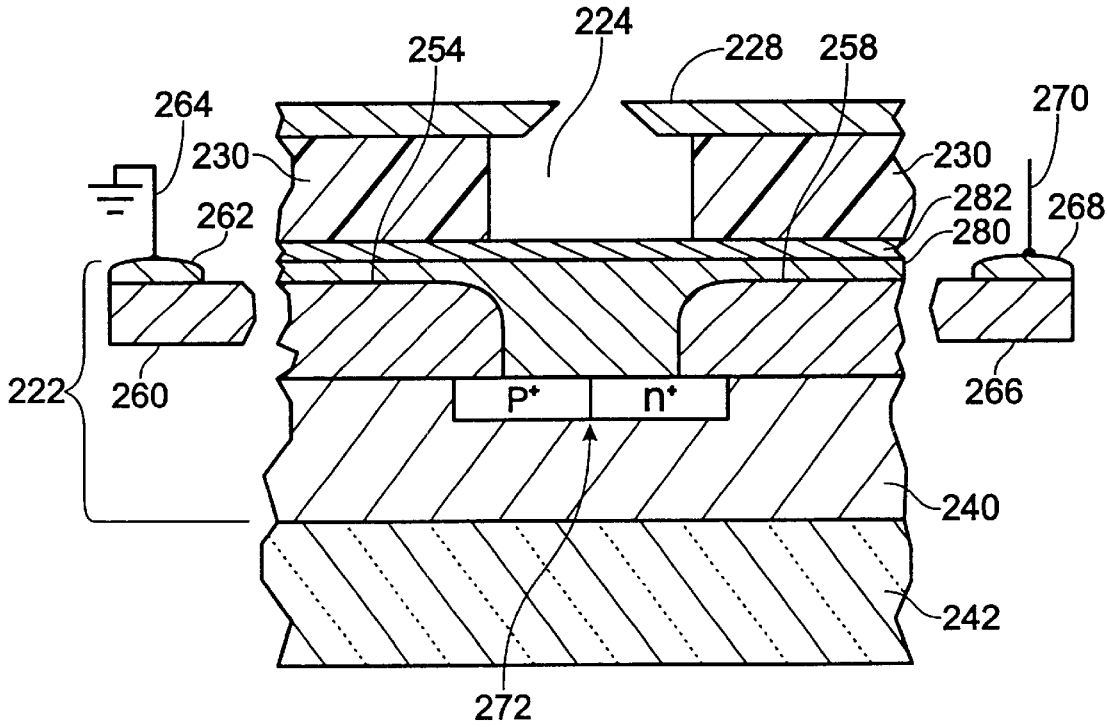
FIG. 5 is a cross-sectional view of an embodiment of a high-temperature, diode-type drop ejector formed in accordance with the present invention.

FIG. 5 depicts another embodiment of a drop ejector, featuring a high-temperature diode 222. In this embodiment, the silicon carbide substrate 240 is doped to form a resistive diode junction 272. As in earlier embodiments, the illustrated diode 222 and associated ink chamber 224 represent one of an array of many drop ejectors that are built into the print head.

Preferably, the array of diodes is controlled by row/column multiplexing. Thus, each diode 222 has a conductive row-select line 254 and column-select line 258, which, in the vicinity of the diode are formed in a manner comparable to the respective source and drain conductors 54, 58 described above.

The row-select line 254 extends from the diode junction 272 to a location where its exposed terminus 260 is covered with another conductive contact layer 262 that is common to a row of diodes and to which a lead 264 is connected and selectively switched to ground during row/column multiplexing.

Similarly, the column select line 258 extends to a location where its exposed terminus 266 is covered with another conductive contact layer 268 that is common to a column of diodes and to which a lead 270 is connected and selectively powered during the multiplexing.

As in earlier embodiments, the just described diode and conductor components 254, 258 are covered with a passivation layer 280 that generally matches the passivation layer 80 described above. In addition, another protective layer in the form of a cavitation-protection layer 282 is applied over the passivation layer 280. This layer 282, like the above-described layer 82, eliminates or minimizes mechanical damage to the diode components and to the passivation layer.

In the embodiment of FIG. 5, the barrier layer 230 and orifice plate 228 are configured and arranged in the same manner as was described above in connection with the barrier layer 30 and orifice plate 28 of the other embodiments.

Having here described preferred embodiments of the present invention, it is anticipated that suitable modifications may be made thereto by individuals skilled in the art within the scope of the invention. For example, the exact configuration, size, and quantity of materials used to produce the drop ejector of the present invention may be suitably varied. Likewise, the basic circuit fabrication techniques referenced herein may also be varied as desired. Thus, although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A drop ejector for an ink-jet print head comprising:

an ink chamber containing a volume of ink; and a transistor that is located adjacent to the ink chamber and operable so that heat transfers from the transistor for heating the ink in the chamber by an amount sufficient to eject some of the ink from the chamber.

2. The drop ejector of claim 1 wherein the transistor includes a silicon carbide transistor substrate.

3. The drop ejector of claim 2 wherein the transistor substrate is a single crystal type.

4. The drop ejector of claim 2 wherein the transistor includes an active surface that carries transistor components including a source, gate, and drain as well as discrete conductive layers to which the source, gate, and drain are connected for directing power and control signals to the transistor, the drop ejector further comprising a layer of protective material covering the transistor components on the active surface.

5. The drop ejector of claim 4, wherein the protective layer is silicon nitride that prevents direct contact between the ink and the transistor components.

6. The drop ejector of claim 4, wherein the protective layer is tantalum to protect the transistor components from cavitation effects resulting from the ejection of ink from the chamber.

7. The drop ejector of claim 4, further comprising a layer of barrier material overlying the active surface of the transistor and shaped to define the ink chamber.

8. The drop ejector of claim 2 wherein the transistor substrate further comprises an active surface that carries transistor components thereon for operating the transistor, and a passive surface opposite the active surface, the drop ejector further comprising a layer of barrier material overlying the passive surface of the transistor substrate and shaped to define the ink chamber.

9. The drop ejector of claim 8 wherein the barrier layer is applied to the passive surface so that the ink in the chamber contacts the passive surface of the transistor substrate.

10. The drop ejector of claim 1 further comprising a thermally insulating member to which the semiconductor device is mounted.

11. A drop ejector for an ink-jet print head comprising:

an ink chamber containing a volume of ink; and a diode that is operable for heating the ink in the chamber by an amount sufficient to eject some of the ink from the chamber; and wherein the diode is integrated with the print head in a manner such that the ink chamber is adjacent to the diode for receiving heat from the diode for ejecting the ink.

12. A method of making a print head for an ink-jet print cartridge, comprising the steps of:

providing a base;

attaching to the base a transistor; and defining an ink chamber in the print head for holding a volume of ink adjacent to the transistor so that heat from the transistor is transferred to the ink in the chamber for generating a vapor bubble for ejecting ink from the chamber.

13. The method of claim 12 further comprising the step of fabricating the transistor using p-type silicon carbide as a substrate for the transistor.

14. The method of claim 12 wherein the cartridge is configured for holding a reservoir of ink for supplying the ink chamber and the attaching step includes making a thermally insulating base a part of the cartridge and thereafter fabricating the silicon carbide transistor on the base.

15. The method of claim 12 wherein the attaching step includes the step of providing a silicon carbide transistor substrate upon one surface of which transistor components are mounted, the method also comprising the step of locating silicon carbide material between the ink chamber and the transistor components to prevent contact between the ink and the transistor components.

16. A method of ejecting a drop of ink from an ink-jet print head chamber comprising the step of heating the ink with heat generated by a transistor and by an amount sufficient to propel a drop of ink from the chamber.

17. The method of claim 16 including the step of selectively switching the transistor on and off, thereby to vary the amount of heat generated by the transistor to thus vary the volume of the ink drops ejected from the chamber.

18. The method of claim 16 including the step of directing a volume of ink to the chamber and adjacent to a surface of the transistor for heating by the transistor.

19. The method of claim 16 including the step of providing a silicon carbide transistor substrate as part of the transistor, the substrate having an active surface carrying transistor components thereon and a passive surface opposite the active surface, the method including the step of directing a volume of ink to a location on the active surface to facilitate heating of the volume of ink by the transistor.

20. The method of claim 16 including the step of providing a silicon carbide transistor substrate as part of the transistor, the substrate having an active surface carrying transistor components thereon and a passive surface opposite the active surface, the method including the step of directing a volume of ink to a location on the passive surface to facilitate heating of the volume of ink by the transistor.

* * * * *